US005477211A

United States Patent [19]

Reynolds

[11] Patent Number: 5,477,211

[45] Date of Patent: Dec. 19, 1995

[54] AMBULATORY AID WARNING DEVICE

[76] Inventor: Jeffrey J. Reynolds, 121 Dorcas Dr., Hendersonville, Tenn. 37075

[21] Appl. No.: 325,819

[22] Filed: Oct. 19, 1994

[51] Int. Cl.[6] ..... G08B 21/00

[52] U.S. Cl. ..... 340/689; 135/65; 135/67; 340/540; 434/433

[58] Field of Search ..... 340/689, 540, 340/691; 200/232, 33 A, 61.47; 434/433; 135/67, 65

[56] References Cited

U.S. PATENT DOCUMENTS

| | | | |
|---|---|---|---|
| 2,182,216 | 12/1939 | Staley | 200/232 |
| 2,522,721 | 9/1950 | Mattern | 200/232 |
| 3,885,576 | 5/1975 | Symmes | 131/170 A |
| 4,282,412 | 8/1981 | Florin | 200/52 R |
| 4,931,772 | 6/1990 | Bechtold | 340/573 |
| 4,972,177 | 11/1990 | Nolan | 340/573 |
| 5,008,654 | 4/1991 | Callaway | 340/686 |
| 5,089,808 | 2/1992 | Amirdash | 340/573 |
| 5,289,163 | 2/1994 | Perez et al. | 340/691 |
| 5,331,990 | 7/1994 | Hall et al. | 135/65 |

*Primary Examiner*—Glen Swann
*Attorney, Agent, or Firm*—Robert Treece

[57] ABSTRACT

An ambulation aid warning device for warning the uses when an ambulation aid is about to be used improperly. The device includes one or more gravity sensitive switches to activate an auditory, visual and/or sensory alarm when the ambulation aid is tilted beyond a specified angle.

20 Claims, 2 Drawing Sheets

AMBULATORY AID WARNING DEVICE

FIELD OF THE INVENTION

The present invention relates to warning devices for attachment to an ambulation aid such as a walker, cane or wheelchair, to encourage the proper use thereof.

SUMMARY OF THE INVENTION

The current device is for attachment to durable medical equipment. It may either be added in the form of a kit which is secured to medical equipment, or it may be built into the medical equipment from the factory. The current invention provides an alarm when the user of a walker or similar ambulatory aid is approaching an unsafe or improper use. Typically, improper use will result in a fall and fractures, months of expensive rehabilitation therapy, and lost independence, especially in geriatric cases. The device activates an auditory, a visual, and/or a sensory alarm, whenever the ambulatory aid is tilted beyond a specified angle. The angle of activation is adjustable so that the device may be adapted to various ambulation aids such as walkers, quad canes and even wheelchairs. This adjustability also allows the sensitivity to be customized for the abilities to the user.

Typically, one falls victim to the improper use of an ambulatory aid such as a walker after becoming accustomed to the daily use of it. This is especially true if one has not previously fallen. Such a person often begins to over extend the forward placement of the walker to move further and faster. In such a situation, the walker is placed down on its two back legs as opposed to all four legs as it is required for proper use. Eventually, such a person places body weight and trust in this position and the walker may shoot out forward resulting in a fall. Such a fall will often result in bilateral wrist fractures or a broken hip. The current device alerts the user, so that improper use will not occur.

DETAILED DESCRIPTION OF THE PREFERRED EMBODIMENTS

Figure 1:
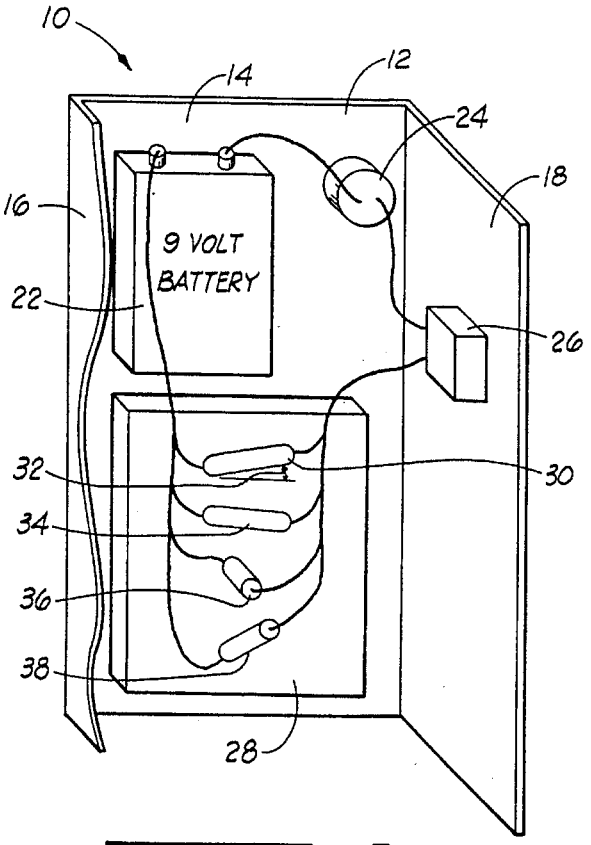
FIG. 1 is a perspective view of a warning device constructed in accordance with the present invention, with portions of the device's case removed for clarity.

Referring to the drawings in detail and to FIG. 1 in particular, reference character 10 generally designates a warning device constructed in accordance with the present invention. The warning device 10 may be built into durable medical equipment, such as a walker, a cane, or a wheelchair. Similarly, as shown in FIG. 1, the device may be mounted in a case 12, so it may be added to an existing ambulatory aid. When the warning device 10 is mounted in a case, such as case 12, preferably the case 12 includes a back plate 14, a left side plate 16, and a right side plate 18. A cover (not shown) may be provided to enclose the remainder of the case.

The warning device 10 includes a power source 22, the power source may be any electrical storage device, but preferably is a battery with a large storage capacity such as the nine volt battery, shown in FIG. 1. The device also includes a warning indicator 24 (such as a buzzes, light or vibrator), and one or more gravity sensitive switches, such as mercury switches. Shown in FIG. 1 are sight mercury switch 30, left mercury switch 34, rear mercury switch 36, and front mercury switch 38. The warning device 10 may also include an on/off switch, such as on/off switch 26. It should be noted that a single switch would warn the user of the most common misuse. For example, a single switch could activate a warning if a walker, wheel chair or other device was tilted to the rear. It should also be noted that although four switches are preferable, three switches could be used to activate the warning when a device is tilted in any direction. In addition, more than four switches could be used to activate the warning device.

Electrical leads connect the power source 22, the warning indicator 24 and the gravity sensing switches 30, 34, 36 & 38 such that when any gravity sensing switch is closed, the warning indicator 24 is activated. As shown in FIG. 1, an on/off switch 26 may be placed at any point in the electrical circuit so that the device may be shut down to conserve power when not in use.

The gravity sensing switches should be designed and positioned in such a manner that tilting the warning device 10 in any direction, beyond a specified degree, will close the circuit and activate the warning indicator 24. Preferable, the gravity sensing switches are a plurality of mercury switches connected parallel such that the closing of any individual mercury switch will activate the warning indicator 24. As shown in FIG. 1, each mercury switch 30, 34, 36 and 38 may be mounted in a mounting block 28. Right mercury switch 30 is mounted at an angle 32, such that when the warning device 10 is tilted to the right, beyond the angle 32, the circuit closes and activates the warning device 24. In a similar manner, left mercury switch 34, is mounted at an angle 32, to activate the warning indicator when the warning device is tilted to the left, beyond the angle 32. Rear mercury switch 36 and front mercury switch 38 are also mounted at angles to activate the warning indicator when the warning device 10 is tilted either to the rear or to the front beyond angle 32.

Figure 2:
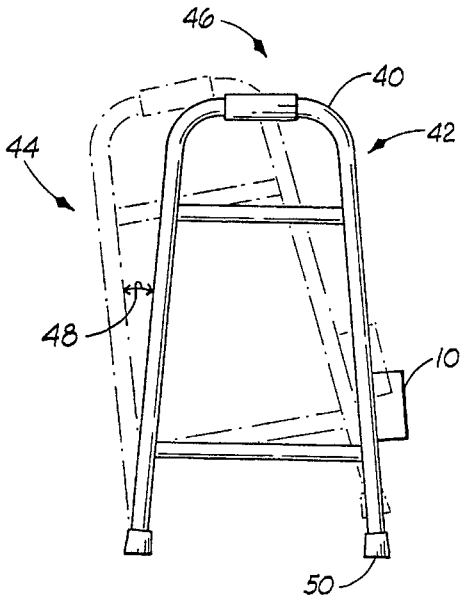
FIG. 2 is an elevational view of a walker, having the warning device of the present invention attached thereto.

The warning device 10 shown in FIG. 2, is attached to a walker 40. The walker has a front 42, a rear 44 and a top 46. When the walker 40 is tilted at an angle 48 to the rear, or in any other direction, the warning device activates, indicating to the operator that an unsafe condition of the walker exists. One or more pressure switches 50 may be attached to the legs of the walker 40 and to the warning device 10 to prevent the warning device from activating when all four legs are firmly placed on the ground. In this way, the walker 10 will not give a false warning when it is used on an incline slope, such as a handicap ramp. However, it should be noted that the angle 48 of activation of the warning device 10 should be such that it would not activate when used on a properly installed handicap ramp.

In an alternative embodiment, the gravity switches 30, 34, 36, and 38, could be eliminated and replaced with pressure switches, such as switch 50 on each of the four legs of the walker. The pressure switches should be wired, such that when any two legs of the walker 40 are in contact with the surface of the ground and the remaining two are not in contact with the surface of the ground, the warning device 10 would activate.

The proper use of a walker includes lifting the walker vertically without tilting the walker, then moving it horizontally away from the user and placing it down. When used properly, the walker should never be tilted, thus the warning indicator 24 would not activate unless the walker was used improperly.

Figure 3:
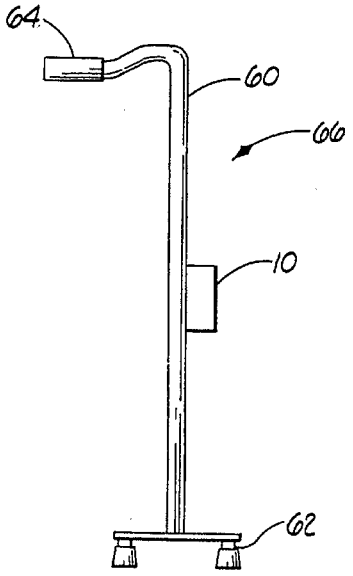
FIG. 3 is an elevational view of a quad cane, having the warning device of the present invention attached thereto.

FIG. 3 shows a cane 66 having the warning device 10 attached thereto. The cane 66 disclosed in FIG. 3 is a quad cane, but it should be noted that the warning device may be used with any multi legged cane, that is, any cane having a plurality of legs. The quad cane 66 of FIG. 3, has cane legs 62 (only one being designated by reference numeral 62 therein), a handle 64 and a front 60. The warning device 10 may be attached to the cane or to the cane legs, so long as it is securely attached and maintains its position relative to the cane 66.

Figure 4:
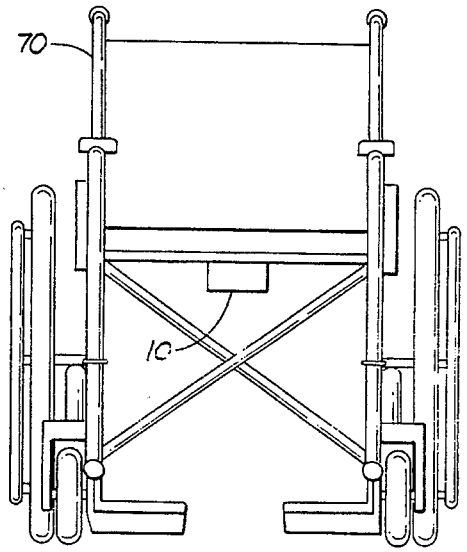
FIG. 4 is a front elevational view of a wheelchair, having the warning device of the present invention attached thereto.

FIG. 4 shows the warning device attached to a wheelchair 70. It should be noted that when attached to a wheelchair, it is not necessary for the warning device 10 to active when the wheelchair 70 is tilted either to the left or to the right, however, the warning device 10 should activate whenever the wheelchair is tilted to the rear. This is because one common, unsafe use of a wheelchair is tilting rearward, which may cause the operator to fall over backwards.

Figure 5:
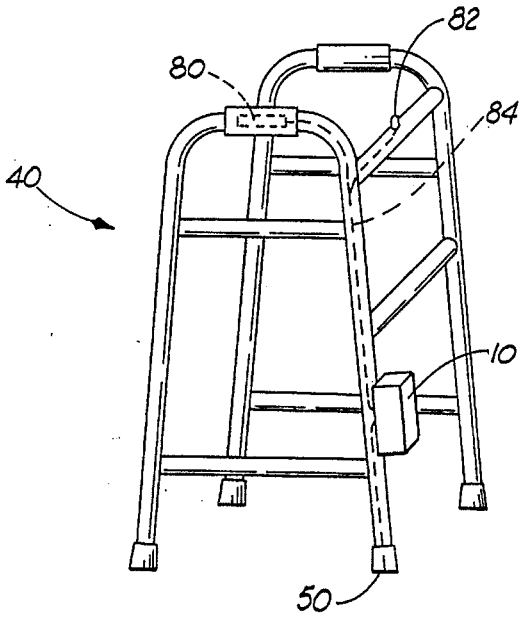
FIG. 5 is a perspective view of a walker, having the warning device of the present invention attached thereto.

FIG. 5 shows a perspective view of the walker 40, with different types of warning indicators attached to the warning device 10. For example, a vibrator 80 may be placed inside the handle of the walker 40 to warn the user by vibrating the walker's handle. Another indicator which may be used, either in conjunction, with the vibrator 80, or separately, is a warning light 82. The light 82 should be attached to the walker 40, along the front portion thereof, so that it is clearly visible to the user, when using the walker 40. The warning light 82 and the vibrator 80 may be used in conjunction with a horn or buzzes. It should be understood that any of the warning indicators may be used alone or in conjunction with one or more of the other warning indicators.

As shown in FIG. 5, pressure switches may also be added as an additional safety device, to either indicate when one or more legs are in contact with the ground, and the remaining legs are not in contact. Additionally, the pressure switches 50 may be used in conjunction with the various warning indicators and gravity switches to activate only when the gravity switches indicate an unsafe position and one or more pressure switches are not in contact with the ground.

Figure 6:
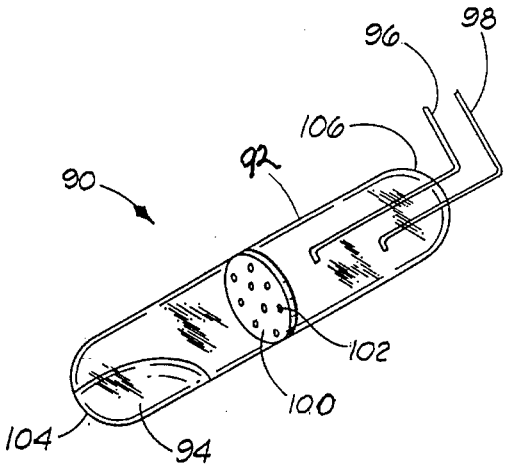
FIG. 6 is an elevational view of a baffled mercury switch, which may be used with the present invention.

FIG. 6 shows an improved mercury switch, which may be used with the current invention. A baffled mercury switch 90 includes a sealed tube, such as glass tube 92, containing mercury 94. A first electrical lead 96 and a second electrical lead 98 extend into the glass tube and may be connected to the warning device, such that it would complete a circuit, when the mercury 94 travels from the first end 104 to the second end 106. One or more baffles 100 placed inside the glass tube 92, between the first end 104 and the second end 106, may be provided to prevent the mercury 94 from bouncing from the first end 104 to the second end 106. In this way, the baffles 100 dampen the movement of the mercury 94, such that minor jars and jolts do not cause the mercury 94 to complete the contact between the first lead 96 and the second lead 98.

A suitable baffle such as baffle 100, includes a disc mounted inside the glass tube 92 at an intermediate point between the first end 104 and the second end 106. Wherein the disc 100 includes a plurality of apperatures 102. There should be sufficient number of baffles 100 with large enough apperatures 102 to allow the mercury 94 to easily move from the first end 104 to the second end 106 whenever the second end 106 is lower than the first end 104. Another possible baffled switch would include ridges or other protrusion which extend from the sides of the tube to dampen the movement of the mercury.

Figure 7:
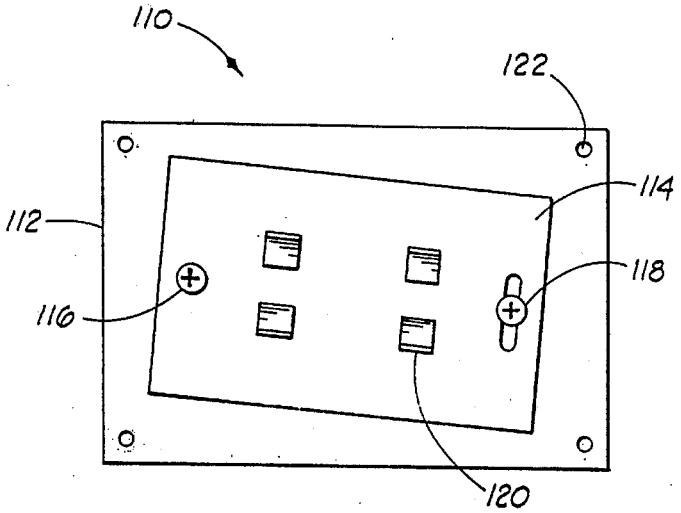
FIG. 7 is an elevational view of a mercury switch mounting means, which may be used with the present invention.

The mercury switches of the present invention may be mounted permanently in the case, or ambulatory aid, however, it has been found that it is advantageous to mount the mercury switches so that they may be adjusted to set the angle of activation and to calibrate the warning device 10 so that each mercury switch activates at a similar angle. One method for accomplishing this is to mount the mercury switches on separate adjustable mercury switch mounts, such as switch mount 110, shown in FIG. 7. Switch mount 110 includes a base plate 112, having attachment holes 122 therein. The base plate 112 may be screwed, tacked, glued, welded, or otherwise secured to the warning device case or ambulatory aid. The switch mount 110 also includes pivotal plate 114. Plate 114 is pivotally connected to the base plate 112 by pivotal connection 116. Connection 116 may be a screw, rivet, or other means of attachment as long as the pivotal plate 114 may pivot relative to the base plate 112. Locking screw 118 may be provided, to attach the opposite end of the pivotal plate 114. In this way, locking screw 118 may be loosened and pivotal plate 114 may be pivoted to set the angle of activation of the mercury switch. The mercury switch should be attached to the pivotal plate by a suitable means. Preferably the mercury switches are attached by means such as holding prongs 120. In this way the mercury switch may be removed and replaced if damaged.

Figure 8:
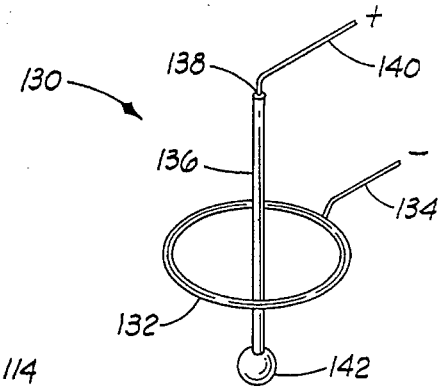
FIG. 8 is a schematic view of an alternate gravity switch, which may be used with the present invention.

FIG. 8 shows an alternative gravity switch which may be used in place of the plurality of mercury switches in the warning device 10. The alternative gravity switch 130, includes a conductive loop 132, connected to a lead 134 to the warning device. A flexible conductor 136 is provided (or a rigid or semi-rigid conductor may be used as long as it is hinged at hinge point 138 or in a similar manner). The flexible conductor 136 is electrically connected to the power supply through lead 140. A weight 142 is attached to the lower end of the flexible connection. In this way whenever the alternative gravity switch is tilted, the flexible lead will come in contact with the conductive loop 132, thereby completing a circuit.

Changes may be made in the combinations, operations and arrangements of the various pairs and elements described herein without departing from the spirit and scope of the invention as defined in the following claims.

I claim:

1. An ambulation aid warning device for alerting a user when the ambulation aid is tilted beyond a specified angle for proper use, comprising:

a case for attachment to an ambulation aid;

a power source attached to the case;

one or more gravity sensitive switches attached to the case whereby gravity causes at least one switch to close when the ambulation aid is tilted beyond a specified angle for proper use;

a warning indicator; and an electrical circuit connecting the power source, the gravity switch(es)and the warning indicator for activating the warning indicator when one or more of the gravity switches are in a closed position thereby alerting the user so improper use will not occur.

2. The warning device of claim 1 wherein the gravity sensitive switch(es) are mercury switches.

3. The warning device of claim 1 wherein the gravity sensitive switches are baffled mercury switches comprising:

a container having a first end and a second end;

electrical contacts extending into the first end of the container;

mercury placed in the container so it may flow from one end of the container to the other, for electrically connecting the electrical contacts when the mercury is in the first end of the container; and one or more baffles between the first end and the second end of the container for baffling the flow of mercury from the first end to the second end of the container.

4. The warning device of claim 3 wherein the baffle comprises a disk attached to the container and wherein the disk has apertures therein for the mercury to flow through.

5. The warning device of claim 1 wherein the warning indicator comprises a buzzer.

6. The warning device of claim 1 wherein the warning indicator comprises a light.

7. The warning device of claim 1 wherein the warning indicator comprises a vibrator attached to the ambulation aid.

8. The warning device of claim 1 further comprising an on/off switch connected to the electrical circuit for breaking the circuit.

9. An ambulation aid having a warning device for alerting a user when the ambulation aid is tilted beyond a specified angle for proper use, comprising:

a power source attached to the ambulation aid;

one or more gravity sensitive switches attached to the ambulation aid whereby gravity causes at least one switch to close when the ambulation aid is tilted beyond a specified angle for proper use a warning indicator attached to the ambulation aid; and an electrical circuit connecting the power source, the gravity switch(es) and the warning indicator for activating the warning indicator when one or more of the gravity switches are in a closed position thereby alerting the user so improper use will not occur.

10. The ambulation aid of claim 9 wherein the gravity sensitive switch(es) are mercury switches.

11. The ambulation of claim 9 wherein the gravity sensitive switches are baffled mercury switches comprising:

a container having a first end and a second end;

electrical contacts extending into the first end of the container;

mercury placed in the container so it may flow from one end of the container to the other, for electrically connecting the electrical contacts when the mercury is in the first end of the container; and baffles between the first end and the second end of the container for baffling the flow of mercury from the first end to the second end of the container.

12. The ambulation aid of claim 9 wherein the warning indicator comprises a buzzer.

13. The ambulation aid of claim 9 wherein the warning indicator comprises a light.

14. The ambulation aid of claim 9 wherein the warning indicator comprises a vibrator.

15. The ambulation aid of claim 9 further comprising an on/off switch connected to the electrical circuit for breaking the circuit.

16. A method for warning the user of an ambulation aid about improper use of the aid comprising: installing an warning device on the ambulation aid wherein the warning device has a power source attached to the ambulation aid; one or more gravity sensitive switches attached to the ambulation aid whereby gravity causes at least one switch to close when the ambulation aid is tilted beyond a specified angle for proper use; a warning indicator attached to the ambulation aid; and an electrical circuit connecting the power source, the gravity switch(es) and the warning indicator for activating the warning indicator when one or more of the gravity switches are in a closed position thereby alerting the user so improper use will not occur.

17. An ambulation aid having a warning device for alerting a user when the ambulation aid is not properly positioned for use, comprising:

a case for attaching to the ambulation aid;

power source attached to case;

a plurality of mercury switches held at an angle by one or more adjustable switch mounts, said switch mount(s) being attached to the case and being adjustable so the angle of each mercury switch may be adjusted to close said switch when the ambulation aid is tilted beyond a specified angle;

a warning indicator attached to the case; and an electrical circuit connecting to the power source, the mercury switch(es) and the warning indicator, said warning indicator activating when a mercury switch is in a closed position to alert the user when the ambulation aid is not properly positioned for use.

18. The warning device of claim 17 further comprising an on/off switch connected to the electrical circuit for breaking the circuit.

19. The warning device of claim 17 wherein the warning indicator comprises a buzzer.

20. The warning device of claim 17 wherein the mercury switches are baffled mercury switches.

* * * * *